US006814772B1

(12) United States Patent
Wake et al.

(10) Patent No.: US 6,814,772 B1
(45) Date of Patent: Nov. 9, 2004

(54) AIR CLEANER WITH LOW PROFILE OUTLET DUCT CONNECTION

(75) Inventors: Jon S. Wake, Verona, WI (US); Donald E. Stiemke, Madison, WI (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 10/242,882

(22) Filed: Sep. 13, 2002

(51) Int. Cl.[7] ..... F02B 77/00

(52) U.S. Cl. ..... 55/385.3; 473/DIG. 28; 473/DIG. 30; 123/198 E; 454/75; 454/158; 156/69; 156/294; 156/304.2; 156/304.6; 156/499

(58) Field of Search ..... 55/385.6, 473, 55/DIG. 28, DIG. 30; 123/198 E; 454/75, 158; 156/69, 294, 304.2, 304.6, 499

(56) References Cited

U.S. PATENT DOCUMENTS 3,293,830 A * 12/1966 McKinlay ..... 55/385.3
3,849,093 A * 11/1974 Konishi et al. ..... 55/385.3
4,197,101 A 4/1980 Cote, Jr. et al.
4,396,407 A * 8/1983 Reese ..... 55/385.3
4,592,316 A * 6/1986 Shiratsushi et al. ..... 55/385.3
4,653,457 A 3/1987 Stege
5,125,940 A 6/1992 Stanhope et al.
5,277,157 A * 1/1994 Teich ..... 55/385.3
5,472,463 A 12/1995 Herman et al.
5,755,842 A 5/1998 Patel et al.
5,755,843 A * 5/1998 Sundquist ..... 55/385.3
5,800,581 A 9/1998 Gielink et al.
5,921,214 A * 7/1999 Fujita et al. ..... 55/385.3
5,954,577 A * 9/1999 Meckler ..... 55/473
6,425,930 B1 * 7/2002 Wake et al. ..... 55/385.3
6,517,595 B2 * 2/2003 Kino et al. ..... 55/385.3

* cited by examiner

*Primary Examiner*—Duane Smith
*Assistant Examiner*—Minh-Chau T. Pham
(74) *Attorney, Agent, or Firm*—Andrus, Sceales, Starke & Sawall, LLP

(57) ABSTRACT

An underhood air cleaner (10) includes a plastic housing (12) having an inlet (14) for receiving dirty air, a filter element (18) for filtering the air, and an outlet (42) for discharging clean filtered air. A plastic outlet duct (40) is butt welded (50) to the housing outlet (42) in axially non-overlapping relation, to eliminate axial overlap previously required for a hose clamp, to reduce the amount of underhood space required by an engine air cleaner in the axial direction.

3 Claims, 4 Drawing Sheets

AIR CLEANER WITH LOW PROFILE OUTLET DUCT CONNECTION

BACKGROUND AND SUMMARY

The invention relates to air cleaners, including underhood air cleaners for a vehicle having an internal combustion engine in an engine compartment covered by a hood, and more particularly to a low profile outlet duct and connection.

In a vehicle having an internal combustion engine in an engine compartment covered by a hood, clean filtered air from the air cleaner is typically routed to the engine via an assembly of tubing consisting of various materials. Often metal tubing, blow molded plastic, or rotationally molded plastic ducting is routed with a number of rubber elbows or cuffs hose-clamped to the ducting to connect and seal the joints. Recent systems include dual durometer blow molded ducting, in which the material composition of the duct is varied throughout its length from a soft elastomeric material on the ends for sealing, to hard plastic material in between for rigidity. Hose clamps are used on each end to seal the duct onto the outlet of the air cleaner and to the inlet of the engine. The air cleaner outlet tube typically has at least about one inch engagement length engaging the outlet duct in overlapping telescoped relation to enable clamping of the outlet duct thereto. In some applications, particularly the noted underhood environment, space limitations require that the outlet duct from the air cleaner be as compact as possible. This often leaves no room for hose clamps and other methods of attachment The present invention addresses the noted space limitation requirement for connecting the outlet duct to the air cleaner, and provides a simple and effective solution. In addition to space savings, the invention also eliminates the need for hose clamps, O-ring seals, gaskets, extraneous hardware, and the use of an elastomeric type cuff or elbow typically required when connecting outlet ducting to an underhood air cleaner.

DETAILED DESCRIPTION

Prior Art

Figure 1:
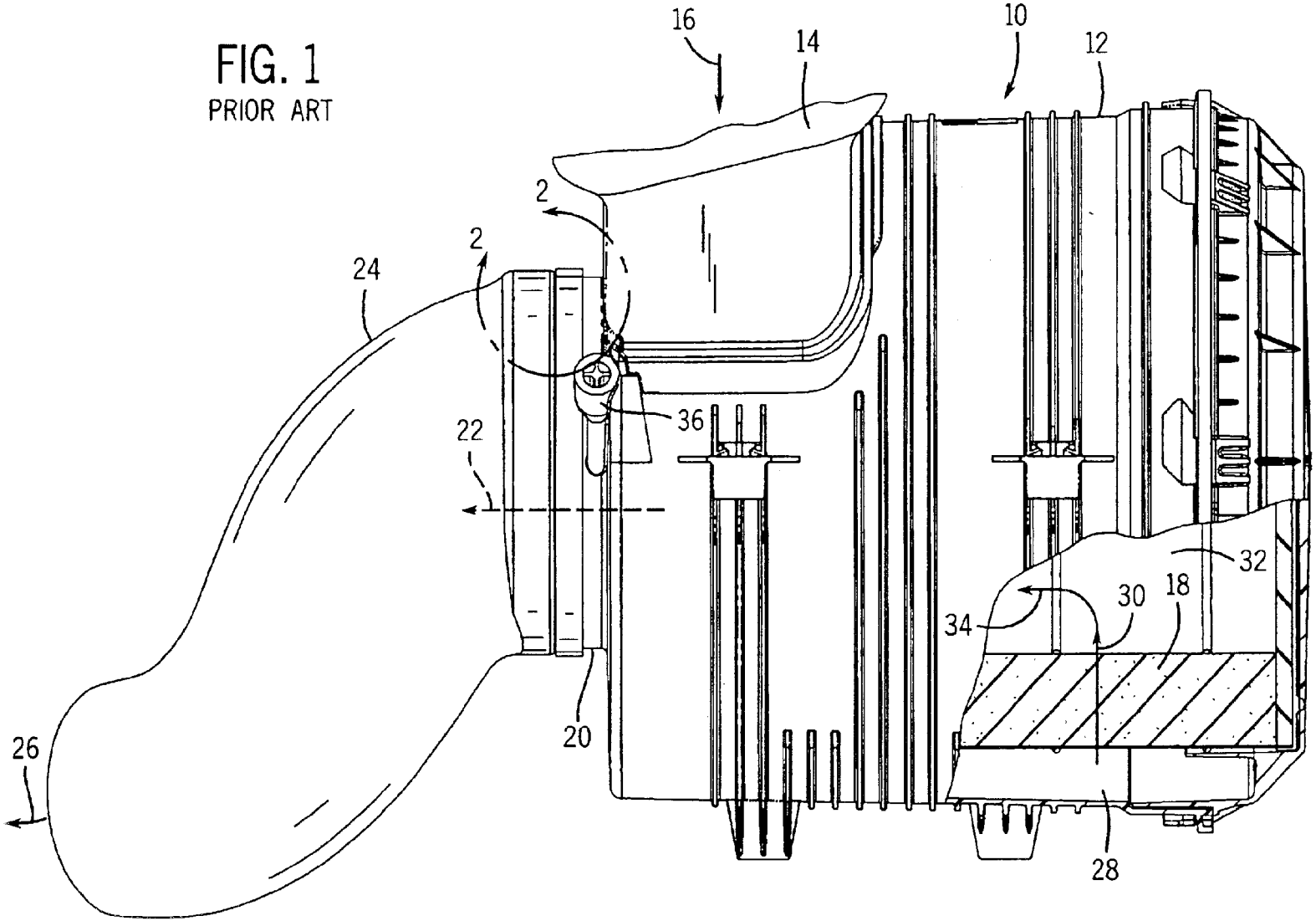
FIG. 1 PRIOR ART
FIG. 1 is a side elevation view partially cutaway of an air cleaner and outlet duct known in the prior art.

FIG. 1 shows an underhood air cleaner 10 for a vehicle having an internal combustion engine in an engine compartment covered by a hood (not shown). The air cleaner includes a plastic housing 12 having an inlet 14 for receiving dirty air as shown at arrow 16, an annular filter element 18 for filtering the air, and an outlet 20 for discharging clean filtered air 22 into duct 24 which directs such clean filtered air to the engine as shown at arrow 26. Dirty air 16 entering inlet 14 flows into outer annular chamber 28 in the housing, and then flows radially inwardly through annular filter element 18 as shown at arrow 30, and then flows axially within hollow interior 32 as shown at arrow 34, and then flows axially through outlet 20 as shown at arrow 22. The housing may include a pressure tap 36 for monitoring pressure drop across filter element 18, to monitor plugging or occlusion of the filter element, to in turn indicate the need for filter element replacement.

Figure 2:
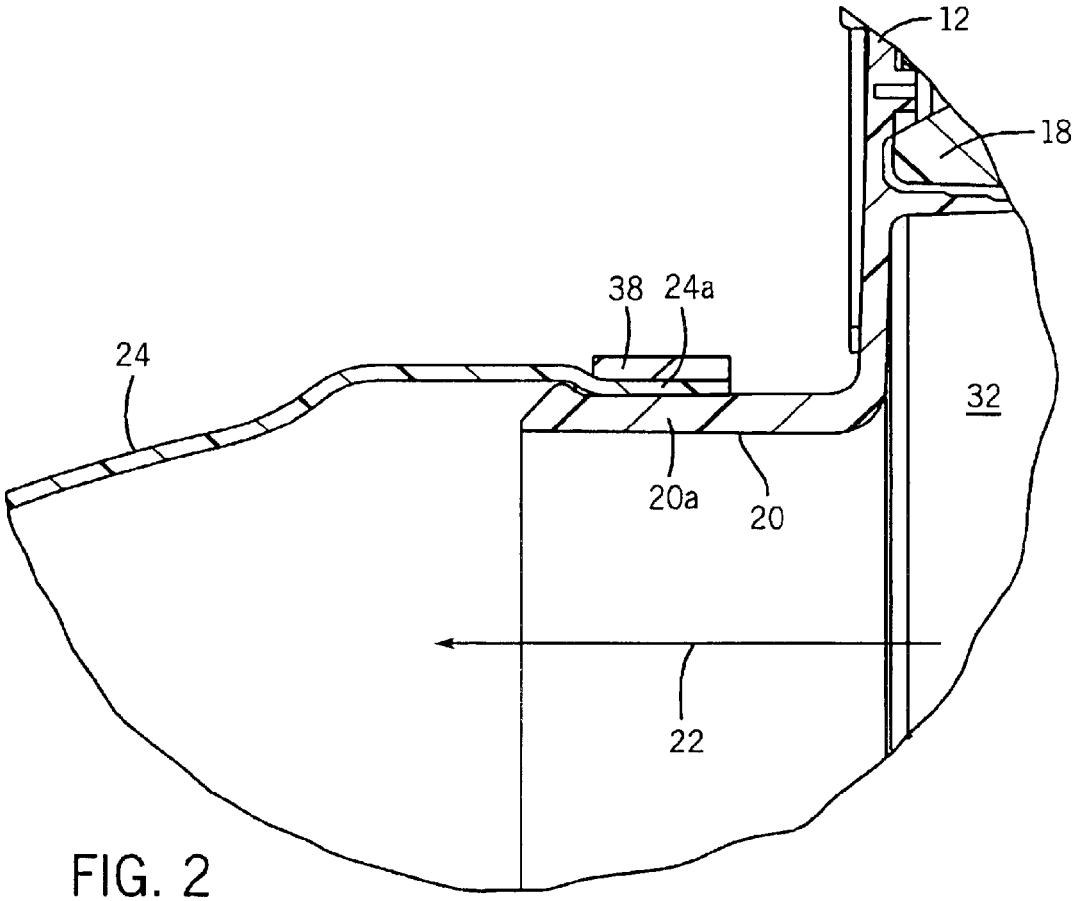
FIG. 2 PRIOR ART
FIG. 2 is an enlarged sectional view of a portion of FIG. 1 as shown at line 2-2.

Outlet duct 24, FIG. 2, is typically mounted to housing outlet 20 by a hose clamp 38 clamping axially overlapped portions 24*a* and 20*a* of the outlet duct and housing outlet, respectively. This clamping arrangement and axially overlapped telescoping engagement typically requires at least about one inch axial engagement length.

Present Invention

Figure 3:
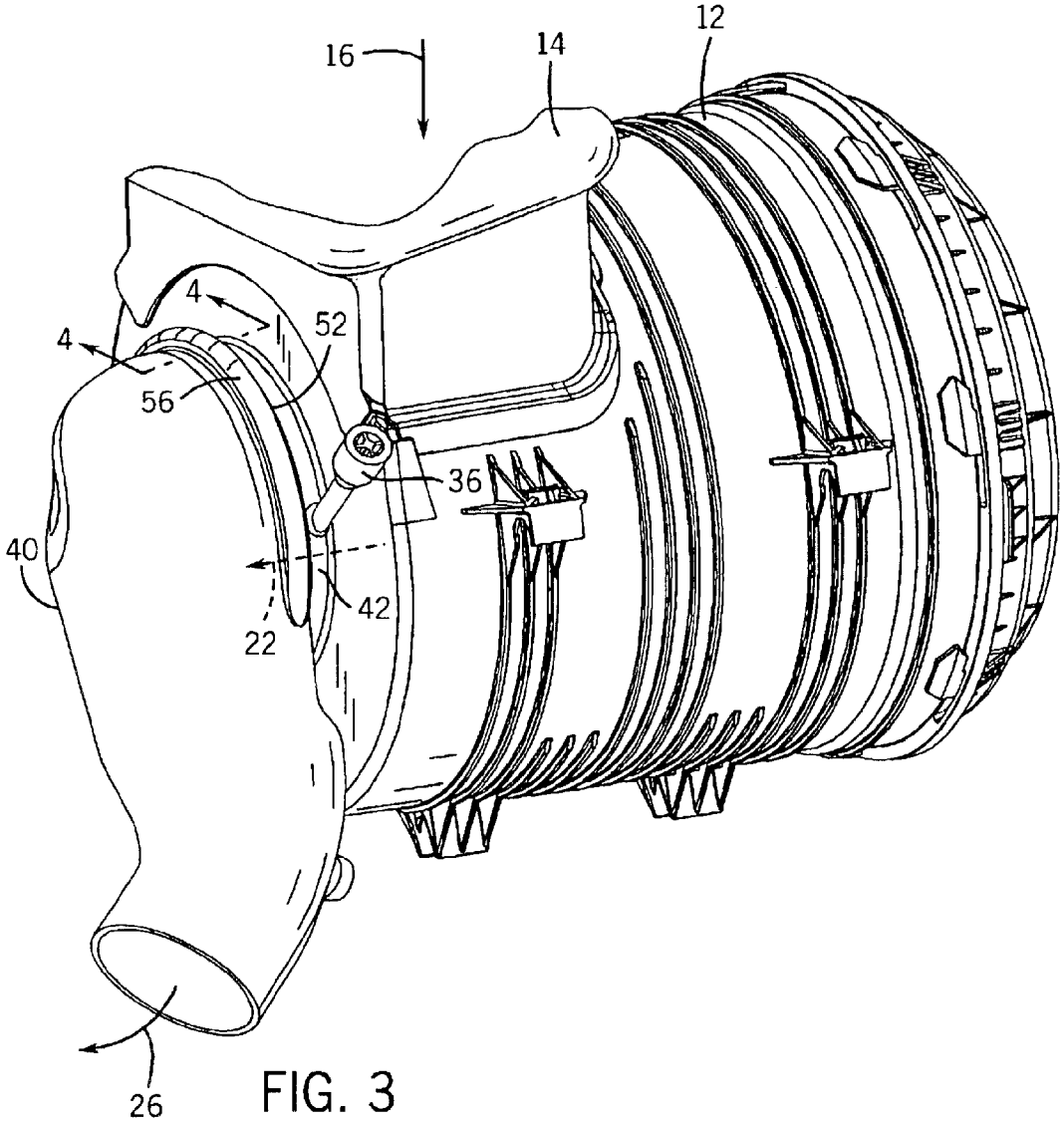
FIG. 3 is a perspective view of an air cleaner and outlet duct in accordance with the present invention.
Figure 4:
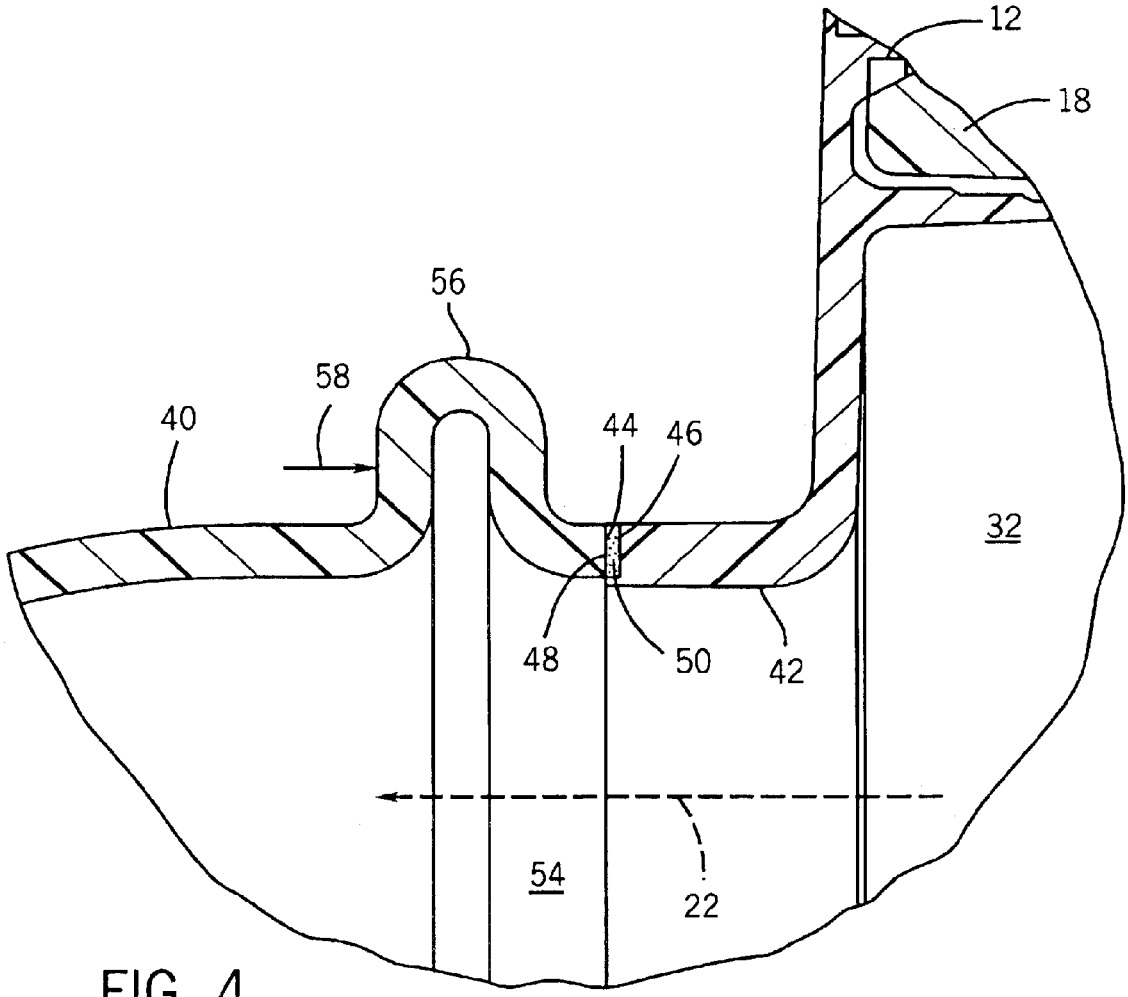
FIG. 4 is an enlarged sectional view taken along line 4-4 of FIG. 3.

FIGS. 3 and 4 illustrate the present invention and use like reference numerals from above where appropriate to facilitate understanding.

In the present invention, a plastic outlet duct 40 is welded to plastic housing 12 at outlet 42 for conveying clean filtered air 22 therefrom. The clean filtered air flows through housing outlet 42 into outlet duct 40 along axial flow direction 22. Outlet duct 40 and outlet housing 42 engage each other along an interface 44, FIG. 4, extending non-parallel, and preferably transverse, to axial flow direction 22. Housing outlet 42 has an axially facing butt end 46. Outlet duct 40 has an axially facing butt end 48. Ends 46 and 48 of housing outlet 42 and outlet duct 40, respectively, engage each other in butt-to-butt relation along interface 44 and are welded to each other, preferably using known welding techniques such as vibration, spin, hot plate, or ultrasonic welding, providing weldment 50 at interface 44. Outlet duct 40 and housing outlet 42 engage each other in axially non-overlapping relation, to eliminate axial overlap, as at 20*a* and 24*a* in FIG. 2, previously needed for clamping the outlet duct to the housing outlet. This reduces the amount of underhood space required by air cleaner 10 in the axial direction.

Outlet duct 40 and outlet housing 42 are butt welded to each other along an annulus 52 defining a cylindrical air flow passage 54 axially therethrough. Outlet duct 40 has a raised arcuate ridge 56 extending partially around such annulus. This ridge enables the outlet duct to be held against the housing outlet as shown at arrow 58, by a tooling mandrel or the like during welding and/or cooling of the parts at weldment 50.

It is recognized that various equivalents, alternatives and modifications are possible within the scope of the appended claims.

What is claimed is:

1. An underhood air cleaner for a vehicle having an internal combustion engine in an engine compartment covered by a hood, said air cleaner comprising:

a plastic housing having:

a housing inlet for receiving dirty air;

a filter element for filtering said air;

a housing outlet for discharging clean filtered air;

a plastic outlet duct having:

a duct inlet welded to said housing outlet;

a duct outlet conveying air to said engine, each of said duct inlet and said duct outlet conveying clean filtered air.

2. The underhood air cleaner according to claim 1 wherein:

said housing outlet and said duct inlet are coaxially aligned along a given axial flow direction;

said duct inlet and said housing outlet are butt-welded to each other along an annulus immediately adjacent to and defining an upstream to downstream cylindrical airflow passage axially therethrough from said housing outlet to said duct inlet.

3. The underhood air cleaner according to claim 2 wherein:

said duct has a raised arcuate ridge downstream of said duct inlet and extending at least partially around said annulus;

said ridge has a tooling engagement surface facing axially downstream and away from said housing outlet, and being engageable by tooling during butt-welding of said duct inlet to said housing outlet.

* * * * *